US009441419B2

(12) United States Patent
Spektor

(10) Patent No.: US 9,441,419 B2
(45) Date of Patent: Sep. 13, 2016

(54) OPTIMIZED SOIL PENETRATING MACHINE

(71) Applicant: Michael B. Spektor, Portland, OR (US)

(72) Inventor: Michael B. Spektor, Portland, OR (US)

(73) Assignee: Michael B. Spektor, Portland, OR (US)

( * ) Notice: Subject to any disclaimer, the term of this patent is extended or adjusted under 35 U.S.C. 154(b) by 287 days.

(21) Appl. No.: 14/455,897

(22) Filed: Aug. 9, 2014

(65) Prior Publication Data

US 2016/0040481 A1 Feb. 11, 2016

(51) Int. Cl.
*E21B 4/14* (2006.01)
*E21B 7/26* (2006.01)

(52) U.S. Cl.
CPC *E21B 4/145* (2013.01); *E21B 7/26* (2013.01)

(58) Field of Classification Search
CPC ..... E21B 4/145; E21B 4/14
See application file for complete search history.

(56) References Cited

U.S. PATENT DOCUMENTS 3,137,483 A * 6/1964 Zinkiewicz ..... E02D 11/00 173/137
3,642,076 A * 2/1972 Coyne ..... E21B 4/145 173/135
9,371,692 B2 * 6/2016 Eddison ..... E21B 4/14
2006/0207794 A1 * 9/2006 Spektor ..... E21B 4/145 175/19

* cited by examiner

*Primary Examiner* — Kipp Wallace

(57) ABSTRACT

The optimized soil penetrating machine is characterized by parameters that are optimized with respect to maximum kinetic energy that the machine cyclically obtains for soil deformation during the forward mode of operation. The optimization of the parameters is based on the author's analytical investigation that revealed the existence of the optimal values of the lengths of the striker and its forward stroke at which the machine's kinetic energy reaches its maximum value, resulting in the maximum performance efficiency. The investigation shows that the optimal value of the length of the striker is shorter than the length of its forward stroke. In the existing machines the striker is longer than its forward stroke. This investigation also shows that the efficiency of the existing machines is about 2.5 times less than for their optimized hypothetical counterparts. Since the existing machines cannot be optimized it is required to implement new design concepts.

5 Claims, 9 Drawing Sheets

SECTION 3-3

SECTION 2-2

SECTION 4-4

SECTION A-A $$L_{opt} = L\frac{L + l - \frac{d^2}{D^2}}{2(L + l) - \frac{d^2}{D^2}}$$

FIG. 9

$$S_{opt} = L\frac{L + l}{2(L + l) - \frac{d^2}{D^2}}$$

FIG. 10

OPTIMIZED SOIL PENETRATING MACHINE

FIELD OF INVENTION

The present invention belongs to the group of pneumatically operated self-propelled soil penetrating reversible machines that are mainly used for making underground horizontal holes for lineal communications such as cables and pipes. In the mining industry these machines are used for making horizontal or inclined holes for ventilation and holes for explosives.

BACKGROUND OF THE INVENTION

Pneumatically operated self-propelled soil penetrating machines are widely used for trenchless installation of cables and pipes, and for similar purposes. Typically these machines comprise as major assemblies a tubular housing, an air distributing mechanism, a striker, and a chisel. The striker cyclically reciprocates Inside of the tubular housing. The motion of the striker is caused by the compressed air. A working cycle of the machine consists of a forward and backward strokes of the striker. The majority of these machines can work in forward and also in reverse modes of operation. The penetration of the machine into the soil occurs during the forward mode of operation. In this mode of operation the striker at the end of its forward stroke imparts a blow to the chisel. This results in an incremental penetrating of the machine into the soil. In the reverse mode of operation the striker at the end of its backward stroke imparts a blow to an appropriate component that is rigidly connected to the tubular housing. As a result of this the machine incrementally moves backward in order to get out from the hole.

Numerous US patents describe the designs of these machines. The following US patents represent some examples of certain design features of these machines: U.S. Pat. No. 3,651,874 (March 1972); U.S. Pat. No. 3,708,023 (January 1973); U.S. Pat. No. 3,737,701 (April 1973); U.S. Pat. No. 3,744,576 (July 1973); U.S. Pat. No. 3,756,328 (September 1973); U.S. Pat. No. 3,865,200 (February 1975); U.S. Pat. No. 4,078,619 (March 1978); U.S. Pat. No. 4,214,638 (July 1980). An analysis of some patents can be found in U.S. Pat. No. 5,031,706 (July 1991) and U.S. Pat. No. 5,336,487 (July, 1993) issued to Spektor (the author of the present invention). It is important to emphasize that all currently existing on the market machines incorporate the same design concept of the machine that is described in U.S. Pat. No. 3,651,874 that is issued in March 1972 to Sudnishnikov et all. All related patents issued later offer certain improvements without any change in the concept of the structural design that is presented in the above mentioned U.S. Pat. No. 3,651,874. One of the disadvantages of the machine according to the U.S. Pat. No. 3,651,874 is associated with its air distributing mechanism that severely limits the possibility to increase the length of the striker's stroke. Actually, the air distributing mechanism according to the U.S. Pat. No. 3,651,874 supports relatively short strokes with no possibility of any essential increase of the stroke. The reason for this is associated with the design specifics that control the delivery of compressed air for the backward stroke. Without considering the details, it should be emphasized that in the existing machines, the backward stroke of the striker is caused by an injection of compressed air, not by a continuous flow of compressed air. In general, an injected portion of compressed air can support just a limited backward stroke. The air distributing mechanism, according to the above mentioned patent, is designed in such a way that a significant part of the cross-sectional area of the striker is constantly subjected to the action of the nominal air pressure to enable the forward stroke and in the same time to resist to the backward stroke. This results in a relatively short backward stroke. The importance of the length of the stroke for the improvement of the efficiency of the machine is presented below.

The length of the stroke determines the striker's kinetic energy which is equal to the product of multiplying the compressed air force by the length of the stroke. The nominal pressure of the air is predetermined by the norms of the industrial compressors. Thus, for a certain machine the only parameter that could change the kinetic energy of the striker is the length of its stroke. The sum of the lengths of the striker and its forward stroke (for the forward mode of operation) can be considered as the effective length of the tubular housing.

The efficiency of the machine in the forward mode of operation is proportional to the kinetic energy that the tubular housing (including all associated parts) obtains as a result of an impact of the striker. The most important characteristic of the machine is its efficiency during the forward mode of operation. In the proposed invention the concept of optimization of the parameters of the machine is developed for the forward mode of operation. However the optimization of the parameters results in improvement of the reverse mode of operation as well.

Thus, the shorter the length of the striker the longer is its forward stroke, and as a result of this, the higher impact energy the striker possesses before the impact (and vice versa). The kinetic energy of the tubular housing depends on the amount of impact energy of the striker and of the level of energy transfer from the striker to the tubular housing. The level of energy transfer depends on the mass ratio between the striker and the tubular housing (while other factors like hardness, shape, etc being equal). The smaller the mass of the striker the lower is the level of energy transfer, and vice versa. So, a short striker will possess a high impact energy, but the energy transfer will be low, and vice versa. It becomes to be a problem of optimization that may reveal the existence of an optimal value of the length of the striker (or of the lengths of the forward stroke) with respect to maximum kinetic energy that the tubular housing (with the related parts) possesses after the striker imparts a blow to the chisel.

The author of this invention carried out an appropriate analytical investigation of the dynamics of the forward stroke of the striker and the process of energy transfer to the tubular housing. This investigation has revealed the existence of optimal values of the lengths of the striker and its forward stroke with respect to the maximum value of kinetic energy of the tubular housing (with associated parts) obtained as a result of the striker's blow to the chisel. This analytical investigation and its results are not published, however they can be obtained from the author by demand. The existence of optimal values of the lengths of the striker and its stroke with respect to the maximum value of the kinetic energy of the tubular housing (with the associated parts) was not known before. The formulas for calculating the optimal values of the lengths of the striker and its forward stroke are presented in the specification.

The calculations based on this investigation show that the optimal value of the length of the striker is always shorter than the optimal length of the forward stroke, and, therefore, the optimal length of the striker is always less than 50% of the effective length of the tubular housing. In all existing machines the length of the striker is longer than the length of its forward stroke. These calculations also show that a hypothetical optimized machine having the same effective length of the housing as an existing machine would have approximately 2.5 times more kinetic energy per cycle. Actually, the length of the striker's forward stroke of the existing machines does not exceed 25% of the effective length of the tubular housing. Thus, all existing pneumatically operated self-propelled soil penetrating machines are characterized by extremely low efficiency in comparison with the hypothetical optimized machines.

As it was mentioned above, the air distributing mechanisms of the existing machines impose very strict limitations on the increase of the stroke. It is problematic for these machines to increase the stroke even by a few percents.

U.S. Pat. No. 7,273,113 B2 (September 2007), issued to the author of the current invention, describes a soil penetrating machine which is characterized by a long stroke air distributing mechanism. Actually, this machine does not impose limits on the length of the striker's stroke. However, this machine cannot function if the stroke's length considerably exceeds 50% of the effective length of the tubular housing. This can be explained considering a hypothetical machine having the striker shorter than the stroke. During the functioning of the machine the compressed air is cyclically exhausting to the atmosphere through a radial exhaust passage (hole) in the wall of the tubular housing. The distance between the internal forehead surface of the chisel and the exhaust hole is a little longer than the length of the striker. This allows to the striker to overlap the exhaust passage during its forward, while just at the very end of the forward stroke (before the blow) the exhaust passage becomes not overlapped allowing the compressed air behind the striker to escape to the atmosphere. As a result of this, the air distributing mechanism redirects the flow of the compressed air into the space in front of the striker, forcing it to begin its backward stroke. The striker instantly overlaps the exhaust passage, which remains overlapped during the entire backward stroke for the machine according to the U.S. Pat. No. 7,273,113 B2. This can happen if the length of the striker exceeds 50% of the effective length of the tubular housing (and, obviously, longer than its stroke). In a hypothetical case, if the length of the striker is essentially less than 50% of the mentioned effective length, the striker will be not able to overlap the exhaust hole all the time during its backward stroke (because the striker is too short), and the exhaust hole will become open to the atmosphere before the striker will complete its backward stroke. Hence, the compressed air will escape, and as a result of this the functioning of the machine will be terminated.

Thus, the existing air distributing systems of the pneumatically operated soil penetrating machines do not allow for the optimization of their parameters in order to achieve the maximum efficiency of their performance. The main reason for this is, first of all, that the structure of the existing machines does not allow to increase the striker's stroke in a considerable way. However the machine according to the U.S. Pat. No. 7,273,113 B2 (September 2007), issued to the author of the current invention, allows long strokes. But this machine also cannot be optimized due to exhaust issues explained above. The proposed invention represents an optimized pneumatically operated self-propelled reversible soil penetrating impacting machine that is characterized by maximum efficiency of performance in the forward mode of operation.

SUMMARY OF THE INVENTION

The author of the current invention carried out an analytical investigation with the goal to optimize the parameters of a pneumatically operated soil penetrating machine with respect to maximum to its maximum efficiency that corresponds to the maximum kinetic energy that the body of the machine possesses during each cycle. The investigation revealed the existence of optimal values of the lengths of the striker and its forward stroke at which the body of the machine obtains the maximum value of the kinetic energy as a result of the striker's blow to the chisel. The existence of the optimal values of the lengths of the striker and its forward stroke was not known before, and, consequently, there were no objective criteria to evaluate the performance of these machines. The calculations based on this investigation show that the optimal value of the length of the striker is much less than 50% of the effective length of the tubular housing, while in the existing machines the length of the striker accedes 75% of the mentioned effective length. As a result of this, the efficiency of the existing machines is about 2.5 times lower than in the hypothetical optimized machines that would have the same effective length of the tubular housing and its internal diameter.

The structures of the existing machines are not suitable for optimization of their parameters. New design concepts are required in order to achieve the optimization of pneumatically operated soil penetrating machines.

The current invention represents an optimized pneumatic soil penetrating impacting reversible machine that is characterized by maximum efficiency of its performance.

BRIEF DESCRIPTION OF THE DRIVING

FIG. 1 represents a schematic chart of the air control unit.

FIGS. 2A, 2B, and 2C of which FIG. 2B is a continuation of FIG. 2A, and FIG. 2C is a continuation of FIG. 2B, represent a longitudinal sectional view of the optimized pneumatic soil penetrating machine. The components of the machine are positioned for the forward mode of operation at the beginning of the forward stroke of the striker. These figures (2A, 2B, and 2C) are recommended for the front page of the patent.

FIG. 9 represents the mathematical formula for calculating the optimal value of the length of the striker.

FIG. 10 represents the mathematical formula for calculating the optimal value of the length of the forward stroke of the striker for the forward mode of operation.

DESCRIPTION OF THE ILLUSTRATED EMBODIMENT

General Description

Figure 1:
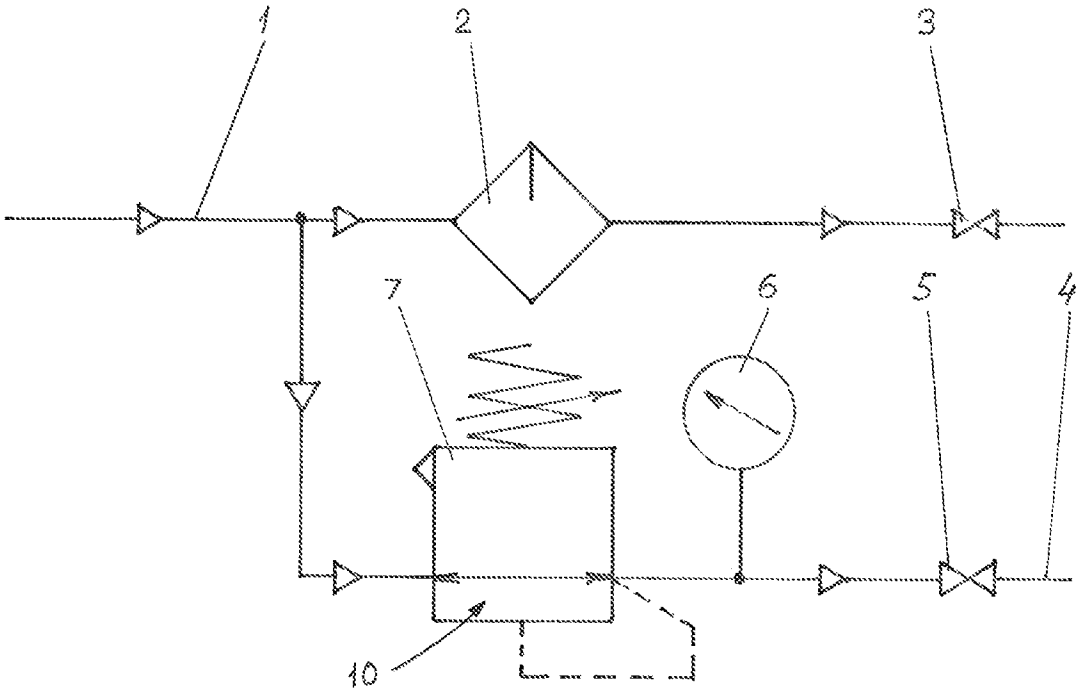

The functioning of the optimized soil penetrating machine is based on two separate lines of compressed air. One air line is connected directly to the source of compressed air and, consequently, delivers the compressed air at the nominal (high) pressure. The other air line is connected to the source of compressed air through a conventional air pressure regulator and delivers the compressed air at a reduced (low) pressure. The nominal (high) pressure line delivers the compressed air for the forward stroke of the striker, while the reduced (low) pressure line supplies compressed air for the backward stroke of the striker. An air control unit 10, schematically shown in FIG. 1, is connected to the source of compressed air and splits the compressed air into two lines. The compressed air line 1 in the FIG. 1 represents the air hose that connects air control unit 10 to the source of compressed air. This line represents the nominal (high) pressure line that through a lubricator 2 and switching valve 3 delivers the compressed air to the machine. In point 21 before lubricator 3 line 1 branches off a second line 22 that through an air pressure regulator 7, switching valve 5, and hose 4 supplies the machine with the reduced (low)) pressure air. Air pressure regulator 7 allows reducing the pressure to the required level, while the air pressure gauge 6 shows the value of air pressure in the reduced (low) pressure line.

FIGS. 2A, 2B, 2C, and 3 show the optimized soil penetrating machine 100 that comprises the following major assemblies:

- a housing assembly 110, including a tubular housing 111 and longitudinal stabilizers 112, 113, and 114 that are rigidly attached to the lateral surface of tubular housing 111;
- a compressed air distributing mechanism assembly 120 including an air control valve chest 121, a double stepped air control valve (air control valve) 122, an adapter 123, a group of bolts 124 (FIG. 3), barbs 125 and 127, hoses 126 and 128, and a protective sleeve 129;
- a striker assembly 130 (FIG. 2B) including a striker 131, bushings 132 and 133, and retaining rings 134 and 135;
- an exhaust control assembly 140 (FIG. 2C) including an exhaust valve chest 141, a step-bushing 142, an exhaust valve 143, and a triangular block 144; and a chisel 150.

Figure 2A:
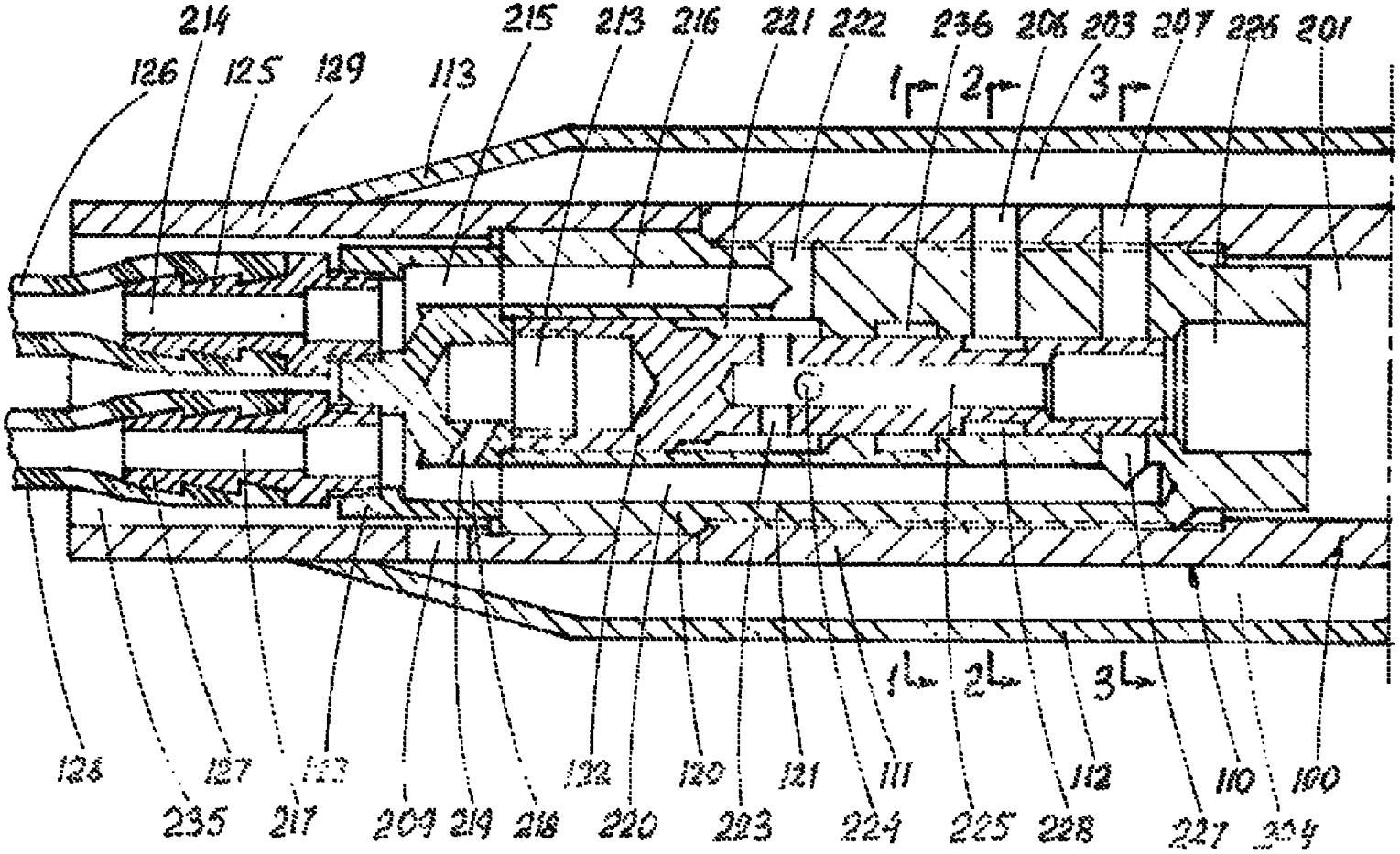
Figure 2B:
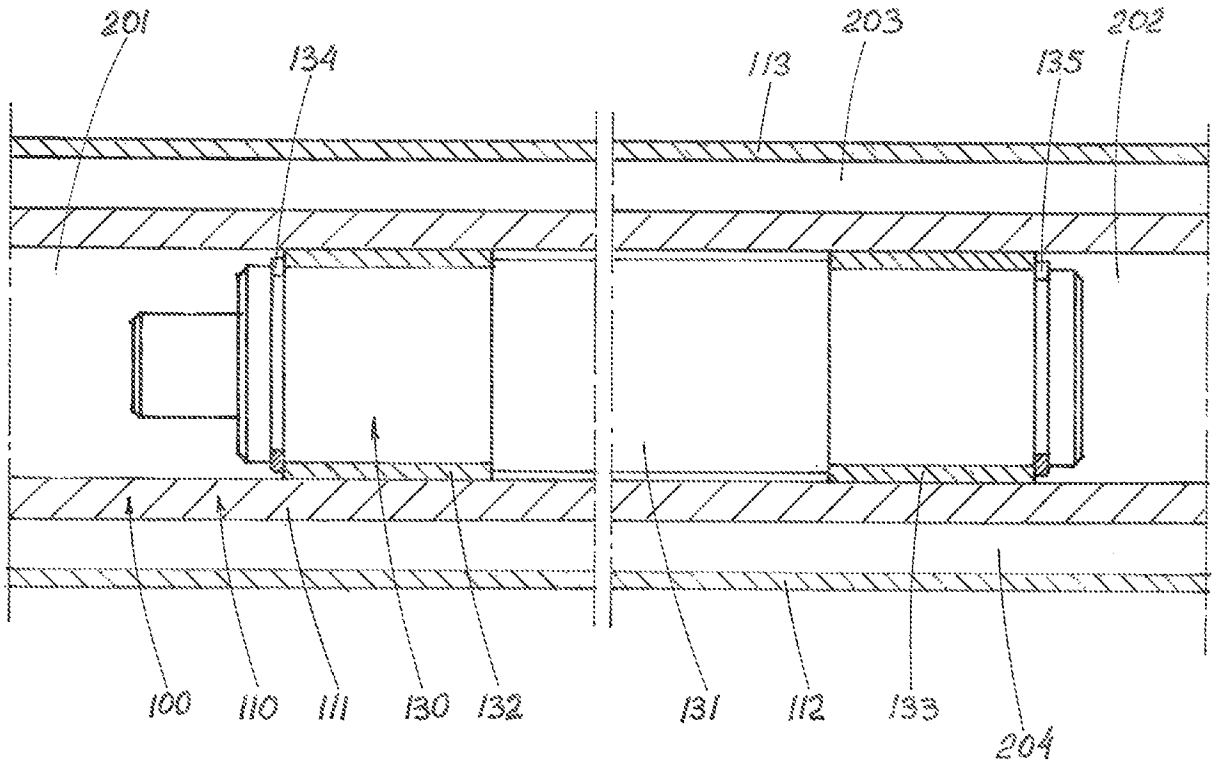
Figure 2C:
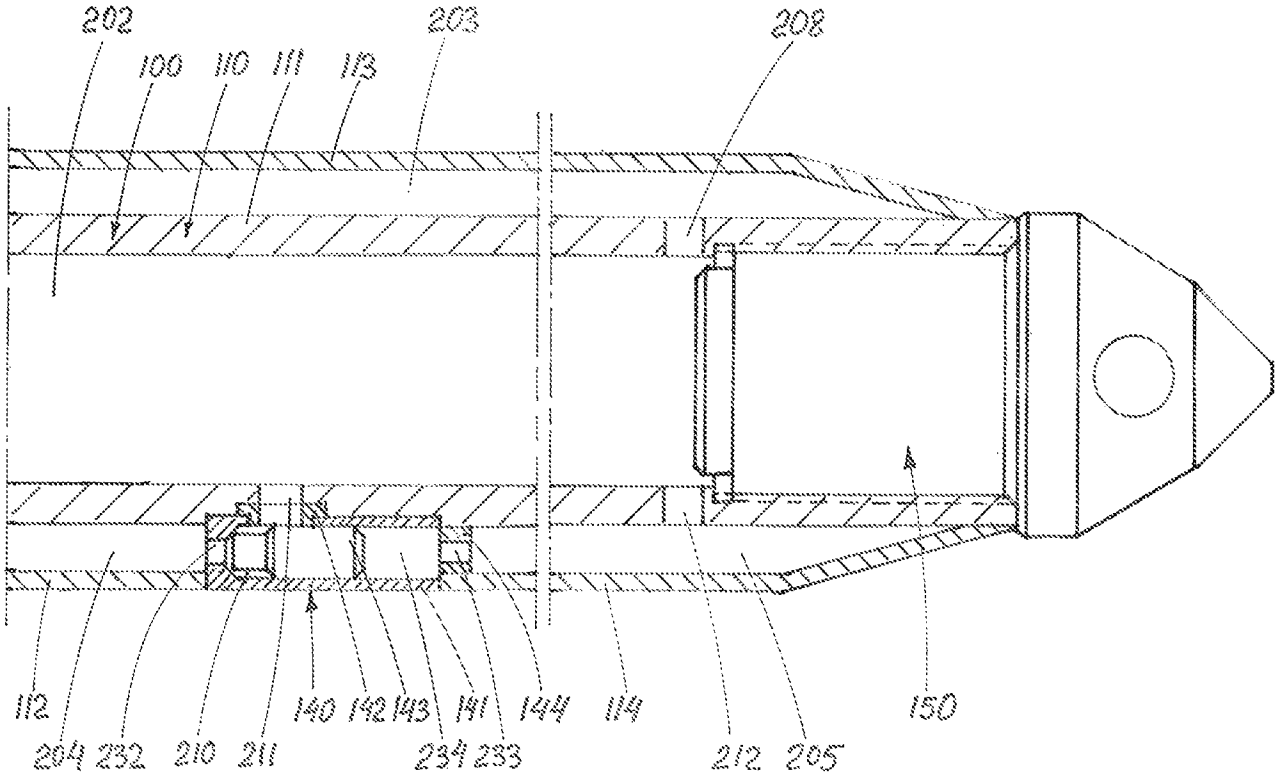
Figure 4:
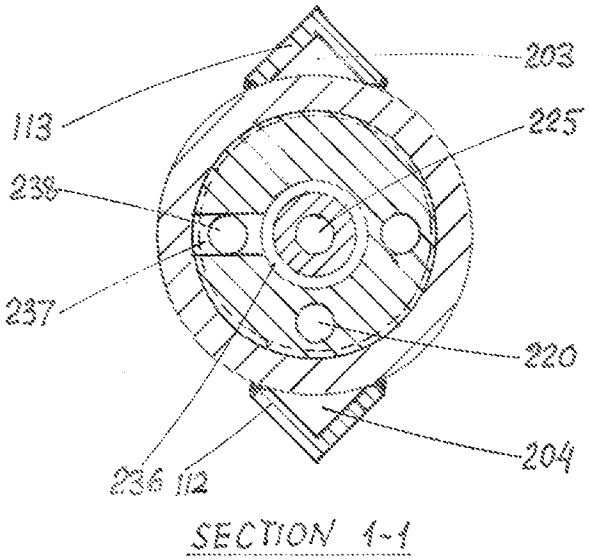
FIG. 4 is a cross-sectional view taken along the line 1-1 in FIG. 2A.

As FIGS. 2A, 2B, and 2C show, air control valve chest 121 is secured by a threading connection to the rear part of tubular housing 111 and is movably accommodating control valve 122. Adapter 123 with barbs 125 and 127 and their hoses is rigidly secured to the rear part of air control valve chest by means of a group bolts 124. Protective sleeve 129 is pressed onto the rear part of air control valve chest 121 and is intended to prevent barbs 125 and 127 and their hoses from damage. Stabilizers 112 and 113 are rigidly secured (by welding) to the lateral surfaces of tubular housing 111 and protective sleeve 129. Striker assembly 130 is movably accommodated inside of the tubular housing 111 and reciprocates between the front part of air control valve chest 121 and chisel 150 that is rigidly secured by a treading connection to the front part of tubular housing 111. Exhaust control assembly 140 is rigidly secured (by welding) to the nest in tubular housing 111.

The space inside of tubular housing 111 between the front forehead surface of air control valve chest 121 and the rear forehead of striker 131 represents a rear chamber 201, while the space between the front forehead of striker 131 and rear forehead of chisel 150 represents a front chamber 202. Barb 125 is secured by a threaded joint to adapter 123 and is connected with an air hose 126 that represents the continuation of the nominal (high) pressure line 1 (FIG. 1) and it is connected to switching valve 3 of air control unit 10. Barb 127 is secured to adapter 123 and is connected to an air hose 128 that represents the continuation of the reduced (low) pressure line 4 that is connected to switching valve 5 of air control unit 10. As FIGS. 2A, 2B, 2C, and 3-6 show, longitudinal stabilizers 112 and 113, representing structural angular shapes, and as it is mentioned above are securely attached (by welding) to the outer surface of tubular housing 111 and protective sleeve 129, creating longitudinal channels 203 and 204 for delivery and exhaust of compressed air. As it is seen in FIG. 2C, the front end of stabilizer 212 is attached to exhaust valve chest 141 of exhaust control assembly 140. Exhaust valve chest 141 has a triangular cross-sectional shape which is similar to the cross-sectional shape of the stabilizers. This allows for a stepless connection of stabilizers 112 and 114 to the rear and front ends of exhaust control valve chest 141. Stabilizer 114 is also rigidly secured to tubular housing 111 and creates an air channel 205. Exhaust control valve chest 141 is aligned with tubular housing 111 by a step-bushing 142 and is securely attached to tubular housing 111. Exhaust valve chest movably accommodates exhaust control valve 143 that is intended to open exhaust passage 211 to the atmosphere at the end of the striker's forward stroke, while keepping this passage closed to the atmosphere during the entire backward stroke of the striker. A triangular block 144 of exhaust control assembly 140 has the same cross-sectional shape as the inner cross-sectional shape of stabilizer 114 and is securely attached to tubular housing 111. Triangular block 144 is intended to stop exhaust control valve 143 when it moves to its extreme right position.

Bushings 132 and 133 of striker assembly 130 are made of low friction materials and are pressed onto the front and rear parts of striker 131. It is possible to build up bushings in their positions on striker 131 by applying welding electrodes of bronze. After welding the bushings should be machined to the required dimensions. In this case retaining rings 134 and 135 are not needed.

Figure 3:
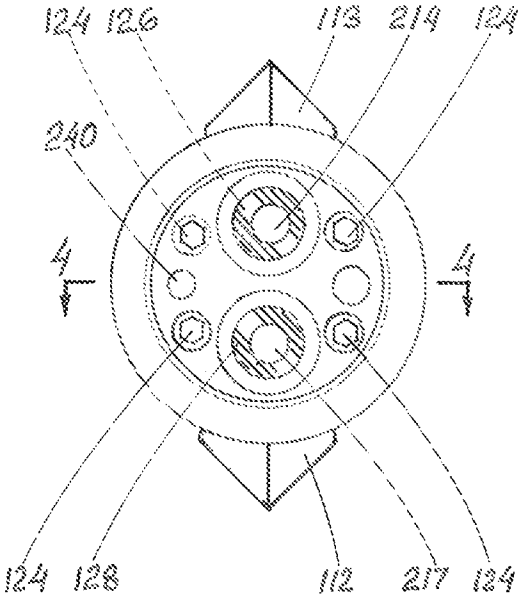
FIG. 3 is a left side view of the machine.
Figure 6:
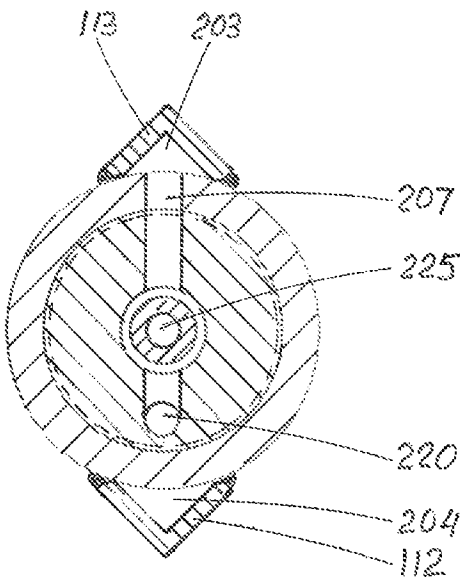
FIG. 6 is a cross-sectional view taken along the line 3-3 in FIG. 2A.
Figure 5:
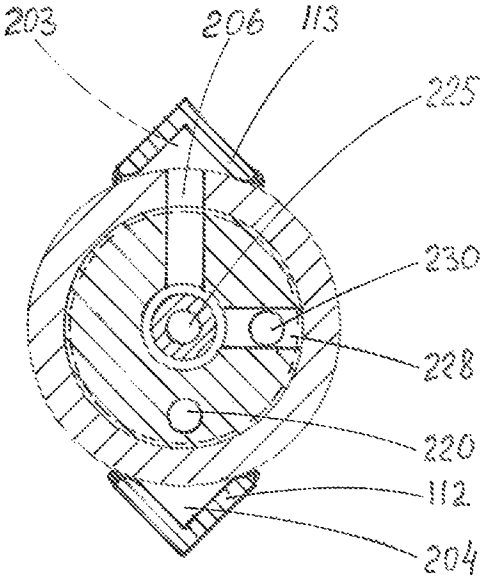
FIG. 5 is a cross-sectional view taken along the line 2-2 in FIG. 2A.

In order to put together the components of the machine it may be recommended the following sequence of assembling operations. Some of these operations represent machining and welding processes. The assembly begins with screwing control valve chest 121 into tubular housing 111. After that, protective sleeve 129 is pressed onto the rear part of control valve chest 121. Then radial holes 206, 207 (FIG. 2A), and 208 (FIG. 2C) should be drilled in tubular housing 111. These holes are drilled in one setup. During the next setup, tubular housing 111 is rotated 180 degrees and a radial hole 209 (FIG. A) is drilled in protective sleeve 129, and also radial holes 211 and 212 (FIG. 2C) are drilled in tubular housing 111. Hole 211 should be counter bored to fit the bigger diameter of step-bushing 142. A nest with a flat bottom should be milled from the external surface of tubular housing 111 in order to accommodate exhaust valve chest 141. After that, step-bushing 142 is jointed with exhaust valve chest 141 which should be installed into the milled nest in tubular housing 111. The next step is to weld exhaust valve chest 141 to tubular housing 111. After that, exhaust control valve 143 is placed into exhaust valve chest 141 and triangular block 144 is secured by welding (bracing) to tubular housing 111. The next operations consist of welding longitudinal stabilizers 112 and 113 to tubular housing 111 and protective sleeve 129. Then longitudinal stabilizer 114 is welded to tubular housing 111. After that, striker assembly 130 is inserted into tubular housing 111 followed by screwing chisel 150 into the front part of tubular housing 111. Thread-lock means should be used to prevent the self loosening of threaded connections. Then double step air control valve 122 is inserted into control valve chest 121 by using a special tool with a threaded end that fits to the threaded hole 213 of double step air control valve 122. Finally, adapter 123 accommodating barbs 125 and 127 with air hoses 126 and 128 is securely attached to control valve chest 121 by a group of bolts 124 (FIG. 3). This concludes the assembly process of the machine.

A. Machine Operation

As it is mentioned above, the air distributing mechanism 120 of the current invention comprises a nominal (high) air pressure line and a reduced (low) air pressure line. The pressure in the nominal (high) pressure line corresponds to the nominal pressure of industrial compressors and is in the range of 100-110 psi. Depending on the level of air pressure in the reduced (low) pressure line the machine 100 can be set to work in the forward mode of operation or in the reverse mode of operation. If the pressure in the reduced (low) pressure line is adjusted to about 30-40 psi machine 100 works in the forward mode of operation. Adjusting the air pressure in the reduced (low) pressure line to about 60-80 psi causes machine 100 to work in the reverse mode of operation. The adjustments of the air pressure in the reduced (low) pressure line by using air pressure regulator 7 (FIG. 1) take just a few seconds and can be done while the machine is working or not.

The air distributing process and the interaction between the components for both modes of operation are considered below.

In both modes of operation, during the forward stroke of the striker assembly 130 rear chamber 201 is connected to the nominal (high) pressure line while front chamber 202 is connected to the atmosphere. At the beginning of the forward stroke the air pressure in rear chamber 201 is the same as in the nominal (high) pressure line. The accelerated motion of striker assembly 130 causes a rapid increase of the volume of rear chamber 201 while the compressed air supply to this chamber through relatively small ducts cannot catch up with the rate of the increase of the volume of rear chamber 201. As a result of this the air pressure in rear chamber 201 gradually drops. However, during the forward mode of operation the air pressure in rear chamber 201 always exceeds the level of the pressure in the reduced (low) pressure line. This allows the striker assembly 130 completing its forward stroke and open exhaust passage 211 in tubular housing 111 just at the very end of the forward stroke before a short instance of imparting a blow to chisel 150. When exhaust passage 211 becomes open, the compressed air from rear chamber 201 escapes to the atmosphere and the air pressure in rear chamber 201 abruptly drops below the level of pressure in the reduced (low) pressure line. This causes a rearrangement in air distributing mechanism 120 resulting in opening the way for the air flow at the reduced (low) pressure to enter into front chamber 202 forcing striker assembly 130 to begin its backward stroke.

However, during the reverse mode of operation the level of the air pressure in the reduced (low) pressure line is relatively high, and as a result of this the pressure in rear chamber 201 becomes lower than in the reduced (low) pressure line before the striker assembly 130 completes its forward stroke. This causes the same rearrangement in air distributing mechanism 120 resulting in connecting chamber 201 to the atmosphere while directing the compressed air at the reduced (low) pressure line into front chamber 202. This slows down striker assembly 130 preventing it from blowing an Impact to chisel 150. The backward stroke begins and at the end of it the striker assembly 130 imparts a blow to control valve chest 121.

The functioning of all components of the machine in both modes of operation will become apparent from the following description.

A.1. Forward Mode of Operation

As it was mentioned above, during the forward mode of operation the striker assembly 130 at the end of its forward stroke imparts a blow to chisel 150, while the motion of striker assembly 150 during its backward stroke is restricted by an air cushion in order to minimize the impact of the striker assembly 130 to air control valve chest 121.

Figure 7:
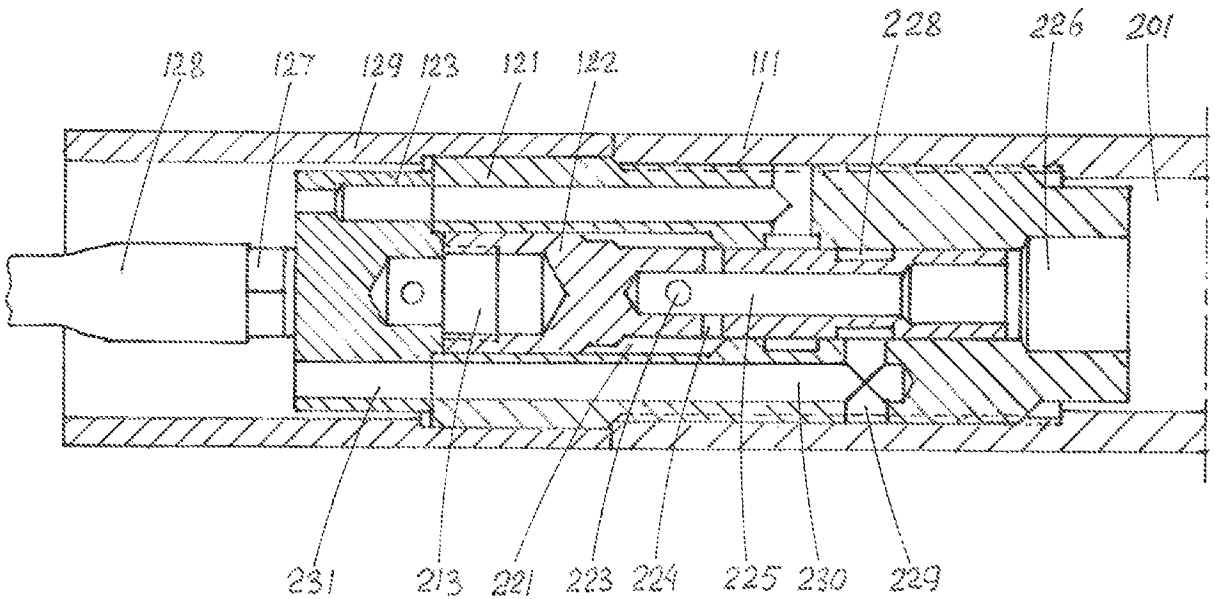
FIG. 7 is a revolved partial longitudinal sectional view taken along line 4-4 in FIG. 3.

Let us consider a working cycle of the forward mode of machine operation. In the FIGS. 2A and 7 air control valve 122 is shown in its extreme left position. However, if machine 100 is not pressurized, the movable components (air control valve 122 and striker assembly 130) will be randomly positioned. The position of exhaust valve 143 does not play any role in starting the working process of machine 100. So, when both pressure lines become pressurized, air control valve 122 will be simultaneously subjected to the action of compressed air at the nominal (high) pressure pushing this valve to the left, and to the action of the compressed air at reduced (low) pressure pushing this valve to the right. This can be seen by tracing the two air flow lines. So, the compressed air at the nominal (high) pressure flows through hose 126, hole 214, duct 215 and hole 216 into radial hole 222 that is always communicating with ring space 221 regardless of the position of air control valve 122. This air pressure pushes air control valve 122 to the left. In the same time the compressed air at the reduced (low) pressure flows through hose 128, hole 217, duct 218, and inclined passage 219 into cavity 213, pushing air control valve 122 to the right. The further interaction of the machine components depends on the positions of striker assembly 130 and air control valve 122. One of the possible options is that this valve is in a position that the compressed air at the nominal (high) pressure can flow from ring space 221 through holes 223 and 224, central hole 225 and cavity 226 into rear chamber 201. In this case it is possible that striker assembly 130 is overlapping exhaust passage 211 (FIG. 3C). Then the compressed air at nominal (high) pressure will be applied to the complete cross-sectional area of air control valve 122 and will create a resultant force pushing this valve to the left. In the same time striker assembly 130 under the pressure of the compressed air in rear chamber 201 will complete its forward stroke and the machine operation will start. However, if in this case striker assembly 130 is at the end of its forward stroke and, consequently, exhaust passage 211 is not overlapped, then rear chamber 201 becomes open to the atmosphere, the pressure in this chamber will abruptly drop, and the compressed air at the reduced (low) pressure will develop a resultant force pushing air control valve 122 to the right. This will enable the compressed air at the reduced (low) pressure to enter into front chamber 202 forcing striker assembly 130 to begin its backward stroke, and the machine operation will start. The other option represents the case when air control valve 122 is in a position in which holes 223 and 224 are blocked, preventing the compressed air at nominal (high) pressure to enter into rear chamber 201. In this case the compressed air at reduced (low) pressure in cavity 213 will develop a resultant force pushing air control valve to the right. This will enable the air flow at the reduced (low) pressure to enter into front chamber 202 forcing striker assembly 130 to complete its backward stroke, and the machine operation will start. The further description of machine operation contains the detailed ways of the compressed air flow for all these cases considered above.

Thus, the operation of the machine will begin regardless of the positions of the movable components before machine 100 is pressurized. This allows to begin the description of the forward mode of operation for the case when air control valve 122 is in its extreme left position, as it is shown in FIG. 2A.

Figure 8:
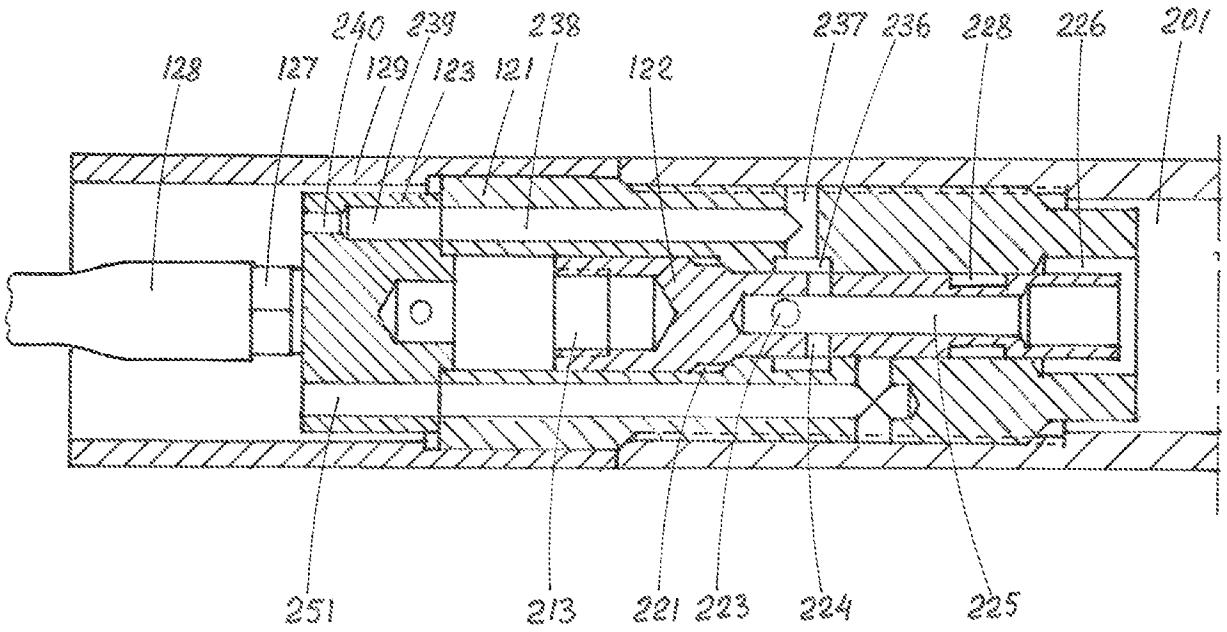
FIG. 8 is a revolved partial longitudinal sectional view similar to the view in FIG. 7 whereas one component (the air control valve) is positioned for the forward mode of operation at the beginning of the backward stroke of the striker (the component has moved from its extreme left position to its extreme right position).

Referring to FIGS. 2A, 2B, 2C, and 4-7, it can be seen, as it was mentioned above, the compressed air at nominal (high) pressure through hose 126, longitudinal hole 214 in barb 125, longitudinal duct 215 in adapter 123, longitudinal hole 216 and radial hole 222 in control valve chest 121 enters into ring space 221. From there the compressed air at nominal (high) pressure flows through radial holes 223 and 224 and central hole 225 in air control valve 122 into cavity 226 in control valve chest 121, and then the compressed air enters into rear chamber 201 developing a pressure on air control valve 122 and striker assembly 130 pushing it to the right and keeping this valve in its extreme left position. At the same time the compressed air at reduced (low) pressure flows through hose 128, longitudinal hole 217 in barb 127, longitudinal duct 218 in adapter 123, inclined duct 219 in adapter 123 and enters into cavity 213 developing a pressure on air control valve 122 to the right. However air control valve 122 remains in its extreme left position since the nominal (high) pressure exceeds the reduced (low) pressure. From duct 218 the compressed air at reduced (low) pressure through longitudinal hole 220 enters into radial duct 227 which is overlapped by air control valve 122 blocking the air flow in the reduced (low) pressure line. The compressed air at nominal (high) pressure flows into rear chamber 201 and forces striker assembly 130 to perform its forward stroke during which front chamber 202 is connected to the atmosphere through radial hole 208 (FIG. 2C), longitudinal channel 203, radial hole 206 (FIGS. 2A, 5, 7), ring space 228, radial hole 229 (FIGS. 5 and 7), and longitudinal holes 230 and 231. The accelerated motion of striker assembly 130 during its forward stroke is slightly elevating the pressure above the atmospheric level in front chamber 202. The slightly pressurized air from front chamber 202 enters into radial hole 208 (FIG. 2C) that, as it is shown above, is connected to the atmosphere and also enters into radial holes 211 and 212. From hole 211 the pressurized air enters into ring space 210 forcing exhaust valve 143 to move to the right. At the same time the pressurized air from hole 212 enters into longitudinal channel 205 and then through duct 233 flows into cavity 234 in exhaust valve chest 141 forcing exhaust valve 143 to move to the left. Since the air pressure on both ends of exhaust valve 143 is the same while the cross-sectional area of cavity 234 exceeds the cross-sectional area of ring space 210, the resultant air pressure force will keep exhaust valve 143 in its extreme left position. It should be emphasized that the distance between radial hole 211 and the rear forehead of chisel 150 is a little longer than the length of striker assembly 130. So, at the end of the forward stroke when striker assembly 130 approaches chisel 150, radial hole 211 becomes open to rear chamber 201 that is still pressurized by the nominal (high) pressure line. Striker assembly 130 imparts a blow to chisel 150 and in the same time the pressurized air from rear chamber 201 enters into radial hole 211 and then into ring space 210 forcing exhaust valve 143 to move to its extreme right position. At this time the air pressure in cavity 234 is close to the atmospheric level and cannot prevent valve 143 from moving to the right. The rear chamber 201 becomes open to the atmosphere through duct 232 (FIG. 2C), longitudinal channel 204, radial hole 209 (FIG. 2A) and space 235 resulting in an abrupt drop of the air pressure in rear chamber 201 where the level of air pressure becomes lower than in the reduced (low) pressure line. As a result of this, air control valve 122 being constantly under the pressure of the reduced (low) pressure line moves to its extreme right position. When air control valve 122 is in its extreme right position, ring space 228 (FIGS. 2A and 7) coincides with radial holes 207 and 227 allowing the compressed air at reduced (low) pressure to flow from longitudinal hole 220 (FIG. 6) into longitudinal channel 203, and from there through radial hole 208 (FIG. 2C) into front chamber 202, forcing striker assembly 130 to start its backward stroke. At the same time the compressed air at reduced (low) pressure through radial hole 212, longitudinal channel 205, and duct 233 enters into cavity 234 forcing exhaust valve 143 to move to its extreme left position. This prevents rear chamber 201 from communicating with longitudinal channel 204 which is always open to the atmosphere. During the backward stroke of striker assembly 130 rear chamber 201 is connected to the atmosphere through cavity 226 (FIG. 2A), central hole 225, radial ducts 223 and 224 (FIG. 8), ring space 236, radial hole 237, longitudinal holes 238 and 239, and orifice 240 (FIGS. 3 and 8). Orifice 240 restricts to some degree the flow of the air from rear chamber 201 decreasing the impact of striker assembly 130 to air control valve chest 121 at the end of the backward stroke. Approaching to the end of its backward stroke, striker assembly 130 pushes air control valve 122 to the left. At the end of the backward stroke, striker assembly 130 imparts a relatively weak blow to control valve chest 121. At this time air control valve 122 is again in its extreme left position and the forward stroke of striker assembly 130 begins. This concludes the description of a working cycle of the machine 100 in its forward mode of operation

A.2. Reverse Mode of Operation

As it is mentioned above, in order to establish the reverse mode of operation it is required to adjust the air pressure in the reduced (low) pressure line to about 60-80 psi. At this mode of operation striker assembly 130 performs a partial (not a complete) forward stroke and is prevented from impacting chisel 150. However at the end of its backward stroke, striker assembly 130 imparts a blow to the front part of air control valve chest 121. The adjustments from one mode of operation to another, as it is mentioned above, can be performed while the machine is working or not. The air distribution and interaction between the components of the machine 100 during the forward and reverse modes of operation are similar.

Consider a working cycle of the machine 100 in the reverse mode of operation. FIGS. 2A, 2B, 2C, 3-7 show the positions of the components at the beginning of this cycle. As in considered above forward mode of operation, the compressed air at the nominal (high) pressure line through longitudinal holes 214, 215, and 216 and radial hole 222 enters into ring space 221 and from there through radial ducts 223 and 224, longitudinal hole 225 and cavity 226 flows into rear chamber 201 forcing striker assembly 130 to begin its forward stroke, and in the same time applying an air pressure force to air control valve 122 keeping it in its extreme left position. Simultaneously, compressed air at the reduced (low) pressure through longitudinal holes 217, 218, and inclined duct 219 enters into cavity 213 developing a pressure force that pushes constantly air control valve 122 to the right. However, similar to the forward mode of operation, at the beginning of the forward stroke of striker assembly 130, the air pressure force that pushes air control valve 122 to the left exceeds the force that pushes this valve to the right. As a result of this, air control valve 122 remains in its extreme left position. Actually, at the beginning of the forward stroke of striker assembly 130 the process of air distribution and the interaction of the components are similar for both modes of operation. The motion of striker assembly 130 is accelerated and the air pressure in rear chamber 201 drops in the same rate as during the forward mode of operation. However in the reverse mode of operation the air pressure in the reduced (low) pressure line is much higher than during the forward mode of operation. As a result of this, the level of air pressure in rear chamber 201 becomes lower than in the reduced (low) pressure line much before striker assembly 130 completes its forward stroke. Thus, during the forward stroke air control valve 122 is already enabled to move to its extreme right position causing a change in the air flows. Rear chamber 201 becomes connected to the atmosphere, while the compressed air at the reduced (low) pressure enters into front chamber 202. The air flows through the same passages as at the end of the forward stroke of striker assembly 130 during the forward mode of operation. Under the action of the compressed air in front chamber 202 striker assembly 130 slows down and begins its backward stroke without touching chisel 150. Approaching to the end of its backward stroke, striker assembly 130 pushes air control valve 122 to the left and then due to the significantly increased pressure in the reduced (low) pressure line imparts a relatively strong blow to the front end of air control valve chest 121. Since air control valve is now in its extreme left position, the striker assembly 130 begins its forward stroke. This concludes the consideration of the working cycle in the reverse mode of machine operation.

B. Mathematical Formulas for Calculating the Optimal Values of the Length of the Striker and of the Length of its Forward Stroke FIGS. 9 and 10 represent the mathematical formulas for calculating the optimal values of the length of the striker and the length of the forward stroke for the forward mode of operation respectively. These formulas were derived on the basis of the analytical investigations carried out by the author of the current invention. The notations in these formulas are:

$L_{str}$ is the optimal value of the length of the striker;

$S_{str}$ is the optimal value of the length of the forward stroke;

L is the length of the tubular housing measured from the front forehead of the air control valve chest and the rear forehead of the chisel. This parameter represents the effective length of the tubular housing and is equal to the sum of the lengths of the striker and its forward stroke;

D is the outside diameter of the tubular housing;

d is the inside diameter of the tubular housing;

l is the sum of the lengths of the solid volume of the rear part of the tubular housing that accommodates the air distributing mechanism, and the solid volume of the front part of the tubular housing including the chisel. The length l should be appropriately adjusted (decreased) accounting that the air distributing mechanism has holes and the chisel is not cylindrical.

It should be noted that in the analytical investigations of the optimization of the parameters of the machine the masses of the stabilizers and the exhaust valve assembly, that have the angular shapes and are welded to the tubular housing, were not taken into consideration since they are insignificant and since not all machines may have these components.

What is claimed is:

1. An optimized soil penetrating machine that is characterized by maximum performance efficiency that is achieved due to the optimization of the machine parameters with respect to maximum kinetic energy that said machine possesses at each working cycle of soil deformation, wherein the machine comprises:

a tubular housing assembly that accommodates other assemblies and components of said machine and includes longitudinal hollow stabilizers that are securely attached to the lateral surface of said tubular housing and create air conduits in order to enable passage of air flows that are required for the operation of said machine;

an air distributing mechanism assembly that governs the air flows of compressed air and includes an air control valve chest that is rigidly secured to a rear part of said tubular housing enabling the compressed air to communicate with said air conduits and with an internal space of said tubular housing; wherein the air distributing mechanism further comprises a double stepped air control valve that cyclically reciprocates inside of said air control valve chest and together with said air control valve chest directs the air flows required for the operation of said machine; and further including an adapter that is securely attached to a rear part of said air control valve chest and is connected to a nominal (high) pressure air supply line and also to a reduced (low) pressure air supply line allowing the air flows from these two lines to enter into appropriate passages and chambers enabling the operation of said machine;

a protective sleeve that is pressed onto the rear end of said air control valve chest and rigidly secured to said stabilizers and creates a ring space for the exhaust of compressed air while preventing connections between the air supply lines and the adapted from being damaged;

a striker assembly that includes a striker and a pair of low friction bushings and reciprocates under the action of the compressed air inside of said tubular housing and cyclically imparts blows enabling said machine to penetrate incrementally into soil or to retract said machine back from the soil;

a chisel that is rigidly secured to a front end of said tubular housing and is cyclically subjected to the blows of said striker assembly at the end of each forward stroke during a forward mode of operation causing the incremental penetration of said machine into the soil, while during a reverse mode of operation said striker assembly at the end of each backward stroke cyclically imparts blows to a front end of said air control valve chest causing said machine to retract incrementally from the hole;

an exhaust control valve assembly including an exhaust control valve chest that is rigidly secured to said tubular housing and is able to communicate through one of the air conduits with the atmosphere and with the internal space of said tubular housing; and also including an exhaust control valve that reciprocates inside of said exhaust control valve chest allowing the compressed air from the nominal (high) pressure line to escape to the atmosphere at the end of the forward stroke of said striker assembly during the forward mode of operation and preventing the compressed air from the reduced (low) pressure line to escape to the atmosphere during the backward stroke of said striker assembly during forward and reverse modes of operation.

2. The optimized soil penetrating machine of claim 1, wherein the compressed air from said nominal (high) pressure line is used for performing the forward stroke of said striker assembly, while the compressed air from said reduced (low) pressure line is used for performing the backward stroke of said striker assembly.

3. The optimized soil penetrating machine of claim 1, wherein switching over from forward mode of operation to reverse mode of operation or vice versa is accomplished by readjusting the air pressure in said reduced (low) pressure line by the help of an air pressure regulator in an air control unit.

4. The optimized soil penetrating machine of claim 1, wherein said exhaust control valve assembly is constantly communicating with the internal space of said tubular housing disposed between a front end of said striker assembly and a rear end of said chisel and prevents the compressed air from said reduced (low) pressure from communicating with the atmosphere during the backward stroke of said striker assembly.

5. The optimized soil penetrating machine of claim 1, wherein the length of said striker assembly is shorter than a length its forward stroke during the forward mode of operation.

* * * * *